United States Patent [19]

Neubaum, deceased et al.

[11] 4,396,461

[45] * Aug. 2, 1983

[54] ONE-SPOT CAR COKE QUENCHING PROCESS

[75] Inventors: Victor A. Neubaum, deceased, late of Coopersburg, Pa., by Neubaum; Doris W., administratrix; S. Robert Schwartz, Valparaiso, Ind.; Robert C. Fetterman; William E. Swan, Jr., both of Chesterton, Ind.

[73] Assignee: Bethlehem Steel Corporation, Bethlehem, Pa.

[ * ] Notice: The portion of the term of this patent subsequent to Aug. 17, 1999, has been disclaimed.

[21] Appl. No.: 289,672

[22] Filed: Aug. 3, 1981

Related U.S. Application Data

[63] Continuation of Ser. No. 89,847, Oct. 31, 1979, Pat. No. 4,344,822.

[51] Int. Cl.[3] ..... C10B 39/08; C10B 39/14

[52] U.S. Cl. ..... 201/39; 202/227

[58] Field of Search ..... 201/39, 41; 202/227, 202/253

[56] References Cited

U.S. PATENT DOCUMENTS

| | | | |
|---|---|---|---|
| 1,677,973 | 7/1928 | Marquard . | |
| 3,806,425 | 8/1971 | Ekholm et al. . | |
| 3,862,015 | 1/1975 | Ouwerkerk . | |
| 3,876,143 | 4/1975 | Rossow et al. . | |
| 4,025,395 | 5/1977 | Ekholm et al. | 201/39 |
| 4,104,130 | 8/1978 | Ealderon | 202/227 |
| 4,196,054 | 4/1980 | Becker et al. | 202/227 |
| 4,201,627 | 5/1980 | Chuss et al. | 201/39 |
| 4,344,822 | 8/1982 | Schwartz et al. | 201/39 |

*Primary Examiner*—Bradley Garris

*Attorney, Agent, or Firm*—John I. Iverson; William B. Noll

[57] ABSTRACT

A process for quenching hot coke in a one-spot coke quench car. The process utilizes a unique arrangement of pipes and spray nozzles to quench the hot coke in a substantially watertight coke quench car having a sloping bottom. A plurality of pipes are directed downwardly from a header mounted on the bench side of the quench car to provide solid streams of water onto the shallow coke bed portion at the top of the sloped bottom for a portion of the quench period. After an initial period a flow of water from a plurality of spray nozzles mounted on additional headers is directed onto the substantially horizontal deep coke bed portion for the remainder of the quenching period. The unvaporized quench liquid is retained in the watertight car until the completion of the quench cycle when it is rapidly drained away.

6 Claims, 3 Drawing Figures

ONE-SPOT CAR COKE QUENCHING PROCESS

This is a continuation, of application Ser. No. 06/089,847, filed Oct. 31, 1979, now U.S. Pat. No. 4,344,822.

BACKGROUND OF THE INVENTION

The present invention relates to an improved process for quenching coke in an installation utilizing a watertight one-spot quench car.

The recent introduction of a one-spot quench car has created some serious problems for the coke manufacturer in the quality of the coke produced. For example, hot coke which is deposited in a one-spot coke quench car from a six meter coke oven forms a high conical pile of hot coke, unlike a conventional car which has a flat profile, with the depth of bed of coke under the peak portion reaching as much as about twelve feet. Difficulty is experienced in getting sufficient quench liquid to all areas of the uneven bed of coke and hot spots in the coke are evident when the quenched coke is dumped on the wharf. The hot spots require additional manual quenching to avoid damage to conveyor equipment. Furthermore, a uniform moisture content throughout the bed of coke is desirable but practically impossible of attainment when conventional spray quenching is practiced.

It is the purpose of this quenching process to produce a quality coke having about 4% to about 10% by weight moisture content with a deviation of less than about ±4% from the average coke moisture of fifty pound samples taken from the car.

Many attempts have been made to apply quench liquid to a bed of hot coke in a manner that will "put out the fire" sufficiently to avoid hot spots while producing a quality coke having a relatively low and substantially uniform moisture content. For example, U.S. Pat. No. 3,806,425 to Eckholm et al discloses quenching coke with solid streams of quench liquid to drive the quench liquid to the bottom of the pile at spaced apart locations so that the quench liquid penetrates the depth of the bed prior to complete vaporization and percolates through the bed quenching coke as it goes. The quench liquid is continuously drained out of the bottom to prevent any accumulation thereof to avoid flooding.

U.S. Pat. No. 3,876,143 to Rossow et al describes a process for quenching coke by independent spray pipes arranged parallel to each other to extend along the length of the coke car. The coke car has an inclined support floor to provide a progressively decreasing depth of coke transverse to the car. The water discharged by each pipe is controlled to sprinkle the maximum depth of coke for an initial period followed by discharge from the other pipes onto successively decreasing depths of coke for progressively decreasing periods of time.

U.S. Pat. No. 1,677,973 to Marquard attempted to control the over and under-quenching of coke by applying a deluge of water through relatively wide angle sprays in five second periods at a rate of 150–200 gals. per second. The water was then allowed to drain and the step repeated for as many sequences as necessary to adequately quench the coke.

After considering these processes for controlling quenching of hot coke in which coke is pushed from a coke oven into a quench car to form peak portions, a process was discovered which applies the quench liquid in a manner and pattern that levels the hot coke and provides for a thorough and uniform quenching of the coke.

SUMMARY OF THE INVENTION

It is therefore an object of this invention to provide an improved process for quenching coke.

It is a further object of this invention to provide a process for quenching coke in a one-spot quench car.

It is an additional object of this invention to provide a process for quenching coke in a one-spot watertight quench car having a sloping bottom to produce quality coke having substantially uniform moisture content.

The present invention accomplishes these objects by providing a plurality of independently operable quench headers mounted substantially parallel to one another and to the longitudinal axis of the one-spot quench car and substantially coextensive therewith. The quench header on the bench side of the quench car is provided with pipes to direct solid streams of quench liquid onto the surface of the shallow coke bed portion formed in the car by the high side of the sloping bottom for a portion of the quench period. After an initial period, sprays of quench liquid from the additional headers are applied to the deep coke bed. The initial flow of streams of quenching liquid from the pipes onto the shallow coke bed portion is directed by the sloping bottom of the coke quench car to the deep coke bed portion on the wharf side of the quench car and fluidizes the coke bed thus effectively leveling the conical pile so that the surface of the coke becomes substantially level. The quench car is provided with means to rapidly drain the unvaporized quench liquid after the quench cycle is complete. A double wall construction of the car provides for venting the steam from the quench car.

The following terms, as used herein, shall have the meanings hereinafter set forth:

"One-spot quench car": a quench car which remains stationary during the time that coke is being pushed from a coke oven into the one-spot quench car.

"Bench side": the side of the quench car adjacent the coke side of a coke oven battery as shown in "The Making, Shaping and Treating of Steel", Ninth Edition, 1971, FIG. 4-25, p. 135.

"Wharf side": the side of the quench car from which the quenched coke is discharged onto a coke wharf.

"Full cone spray nozzle": is a nozzle which produces a conically shaped spray pattern having a relatively uniform distribution of water throughout the entire volume, i.e. a full coverage spray pattern.

"Streams of quenching liquid": the form of the quenching liquid discharged from straight pipes, i.e. solid streams of water with no substantial breaking-up of the stream into drops.

DESCRIPTION OF THE PREFERRED EMBODIMENT

Figure 1:
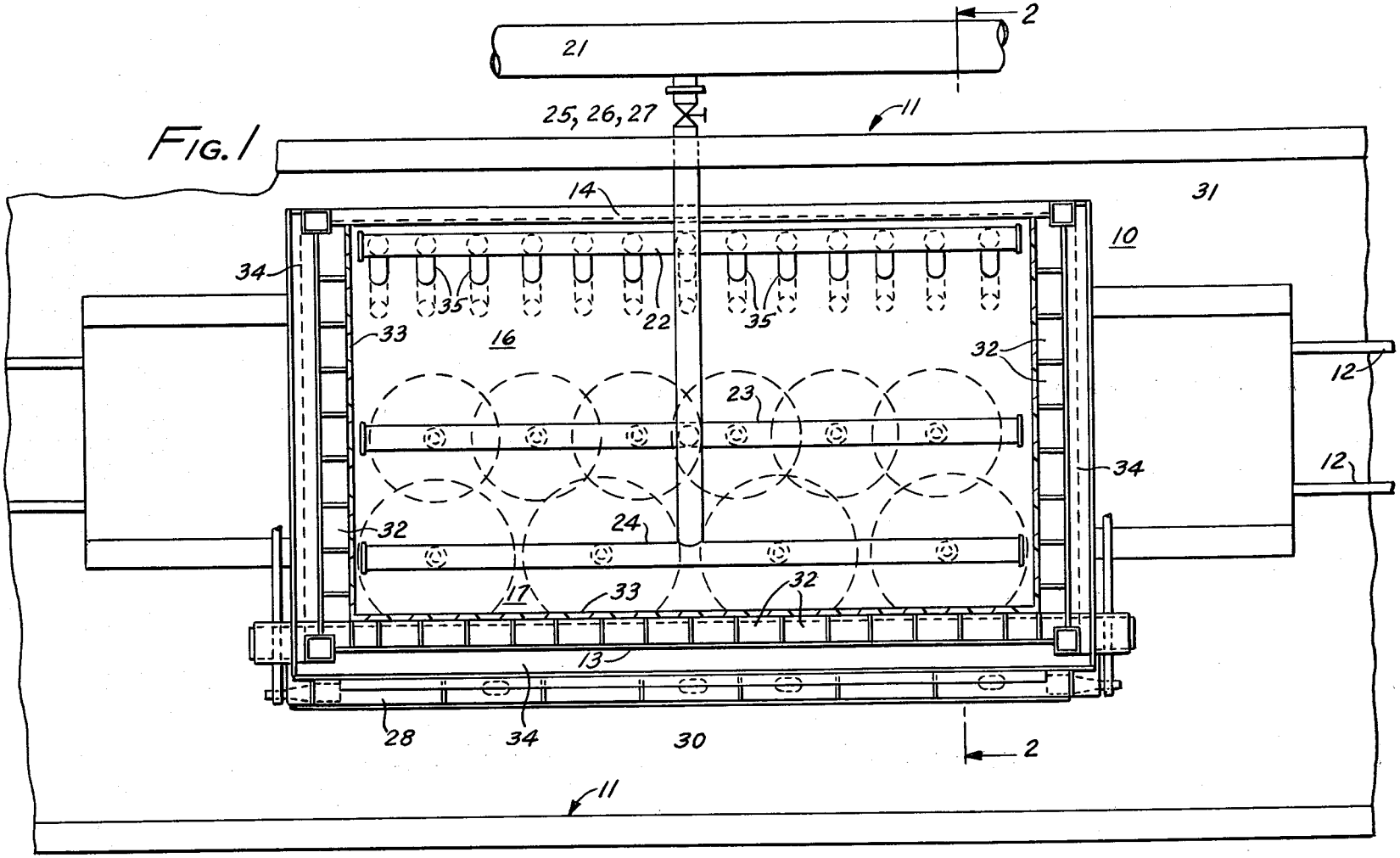
FIG. 1 is a plan view of the one-spot quench car.

Referring now to the drawings, the coke quenching practice for one-spot quench cars will be described in detail. One-spot quench car 10 is seen located in a quenching station 11. The one-spot quench car 10 is moved to the quenching station 11 for quenching of the hot coke when pushing of the hot coke from the oven into the car is complete. Quench car 10 moves along tracks 12 which are located on the coke side of a battery of coke ovens and running parallel to the coke side bench to a quenching station 11 where the hot coke is quenched.

Figure 3:
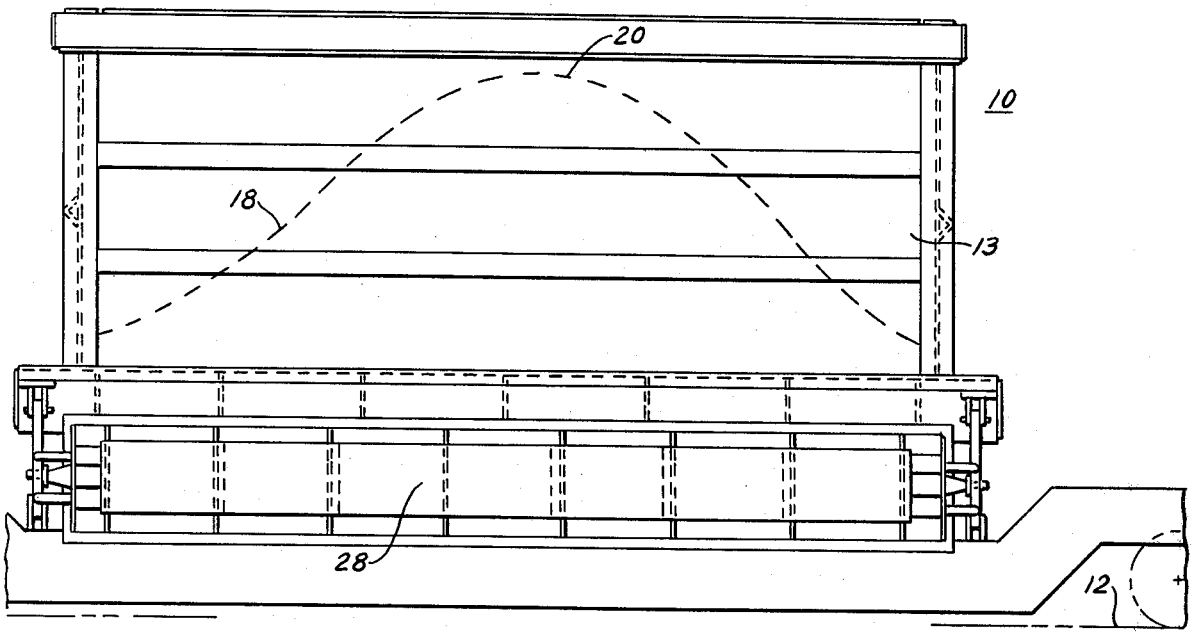
FIG. 3 is a side elevation of the one-spot watertight quench car.
Figure 2:
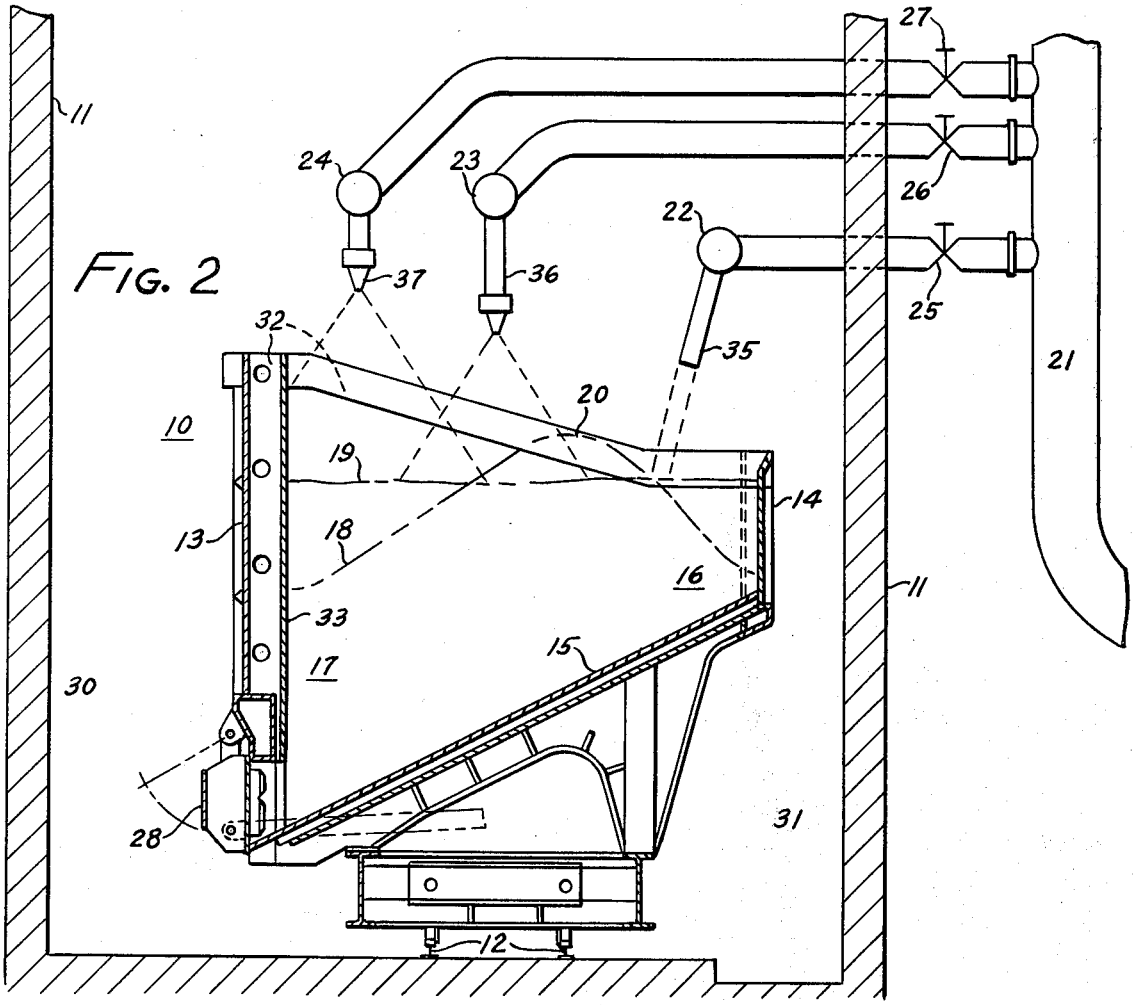
FIG. 2 is a view of the one-spot quench car and quenching station taken on line 2—2 of FIG. 1.

The profile of the coke pile after pushing into the quench car 10 but before quenching appears approximately as line 18 on FIGS. 2 and 3.

Quench car 10 comprises a side 13 which is adjacent the wharf side 30 of the tracks 12 and a side 14 which is adjacent the oven side 31 of the tracks 12. The quench car 10 has a sloping bottom 15 which slopes downwardly from the side 14 of the quench car 10 to the side 13 of the quench car 10 and which produces a shallow coke bed portion 16 and a deep coke bed portion 17. The coke as pushed into the one-spot quench car forms a conical shape including peak portion 20.

As best seen in FIG. 2, a conduit 21 supplies quenching liquid to a plurality of independently operable quench headers 22, 23 and 24 which are mounted in the quenching station 11 above quench car 10 substantially parallel to the longitudinal axis of the one-spot quench car 10 and substantially coextensive therewith. A first quench header 22 adjacent the side 14 of the car is independently operable by means of valve 25 and is provided with a plurality of straight pipes 35 for delivering solid streams of quenching liquid, e.g. water, onto the surface of the shallow coke bed portion 16. Second and third quench headers 23 and 24 spaced from the first quench header 22 and from each other toward the whaft side 13 of the quench car 10 are controlled by means of valves 26 and 27, respectively, and are provided with a plurality of full cone spray nozzles 36 and 37, respectively, for delivering quenching liquid to the surface of the deep coke bed portion 17.

When the shallow portion of the coke bed 16 is quenched, the solid streams of quench liquid from the bench side spray header 22 delivered by nozzles 35 travel to the bottom of the deepest portion of the coke bed 17 and quench the coke at the lower level. In fact the quench liquid builds up due to the watertight feature of the quench car thereby allowing the hydrostatic force of the quench liquid to seek a common level across the length of the car. In this way coke is uniformly cooled by the quench liquid. After a preset time the unvaporized quench liquid is drained from the car in a rapid manner to more accurately control the coke moisture level.

Quench car 10 is provided with discharge gate 28 which is watertight when in closed position but is operable to discharge the contents of the quench car 10 onto the coke wharf. The discharge gate 28 has a partial open mode which allows quenching liquid to drain from the car without discharging the coke.

Quench car 10 is further provided with double wall construction on three sides to provide steam escape channels 32 formed between the inner coke box 33 and the outer coke box walls 34. The double wall forming steam escape channels 32 provides for release of some of the steam pressure built up when the quenching liquid contacts the hot coke in the deep coke bed portion 17 and minimizes the inconvenience of eruptions which create housekeeping problems.

The conical shape 18 with peak 20 of the coke pile pushed from the coke oven (not shown) into the one-spot quench car is also seen in FIG. 3.

General Description

The quenching process described herein quenches hot coke pushed from a slot type coke oven in an essentially watertight "one-spot" quench car. The hot coke from the ovens is conveyed in the watertight one-spot quench car to a spray quenching station, where the car and its contents are drenched with a quenching liquid, e.g. water, distributed in a specified manner over the coke surface until it is quenched. As hereinbefore noted, it is the object of this invention to produce a coke of about 4–10% by weight moisture content with a standard deviation of less than about ±4% from the average coke moisture on fifty pound samples taken from the car.

The process includes putting water on the incandescent coke over a time period of about two minutes, and retaining the majority of the water not vaporized in the watertight quench car for the duration of the quench.

The water is applied to the top surface of the coke via sprays and pipes attached to a plurality of independent headers above the coke surface running parallel to the length of the quench car and substantially co-extensive therewith. The headers and sprays are orientated such that quenching liquid is applied to the upper and lower halves of the coke bed either simultaneously, or in independent time periods during the quench.

The coke quenching practice of the instant invention was used in quench approximately 24 tons of coke from a 6 meter oven. The one-spot quench car has an inside width of 15'6" and an inside length of 25'0" for a horizontal surface area of approximately 388 sq. ft. The location of the spray and pipe headers was as shown on the drawings.

It was found through tests as seen in "Table 1" herebelow that the time of quenching required is between about one and about two minutes, and that the total volume of quenching liquid required is between about 9 and about 12 thousand gallons. It was observed during the tests that the coke bed is rapidly leveled in the quench car (less than 20 seconds after the quench is begun). As might be expected, the coke in the deepest side of the quench car proved to be the most difficult to quench.

After an initial period of between about 50 and about 80 seconds the quench liquid injected by the bench side straight pipes 35 has quenched the shallow coke bed 16 and now begins to flood the deep portion of the coke bed 17. The hydrostatic force of the quench liquid seeking a common level forces the quench liquid uniformly across the length of the deepest portion of the car 17 thereby quenching the coke uniformly. The level of quench liquid from the straight pipes 35 and sprays 36 and 37 builds up to about 4 feet from the bottom point before it is drained by the discharge gates 28 at the end of the quench cycle.

The quenching process incorporates enough flexibility to substantially vary the quenching liquid pattern and amount to allow the establishment of an optimum quenching practice with minimal revision required after installation. The quenching process of this invention has two sets of independently operated sprays and pipes capable of delivering water to specific portions of the quench car for any designated time period. The straight pipes 35 that cover the upper half or shallow coke bed 16 portion of the coke bed are attached to a header 22, designated the bench header, i.e. adjacent the coke side of the coke oven battery. The sprays 36 and 37 that cover the lower half or deep coke bed 17 portion of the coke bed are attached to a header or headers 23 and 24, designated the wharf header. The headers, both wharf and bench, are equipped with control valves upstream of the sprays and pipes. These control valves must have the capability to be operated independently for specified periods of time during the quench.

The installation as described herein establishes an optimum quench practice produced by varying the spray and pipe times, the number of sprays and pipes used on each header, and the start time of the drain cycle.

TABLE 1

"ONE SPOT" CAR QUENCH TESTS

| Test No. | Flow Rate (GPM) | Quench Time (Sec.) | Soak Time (Sec.) | $H_2O$ Temp. (°F.) | Total Gals. | Drain Valves | Total Coke Smpls. | Hot Spot | Avg. Coke Moist. | Std. Dev. |
|---|---|---|---|---|---|---|---|---|---|---|
| 1 | 8580 | 86 | — | 128 | — | Open | 14 | 4 | 3.6 | ±3.64 |
| 2 | 8580 | 86 | — | — | — | Open | 20 | 4 | 10.0 | ±8.37 |
| 3 | 8580 | 88 | — | 127 | — | Open | 20 | 1 | 21.56 | ±10.79 |
| 4 | 8580 | 88 | — | 132 | 12584 | Open | 20 | 3 | 7.3 | ±5.10 |
| 5 | 8580 | 88 | — | 127 | 12584 | Open | 20 | 4 | 10.3 | ±5.60 |
| 6 | 8580 | 88 | — | 132 | 12584 | Open | 20 | 6 | 8.2 | ±5.71 |
| 7 | 9000 | 120 | 25 | 140 | 18000 | Closed | 20 | 1 | 7.6 | ±4.18 |
| 8 | 10000 | 135 | 0 | 131 | 22500 | Closed | 20 | 0 | 10.9 | ±2.14 |
| 9 | 10000 | 135 | 0 | 124 | 22500 | Closed | 20 | 0 | 13.1 | ±5.20 |
| 10 | 7500 | 135 | 0 | 135 | 16875 | Closed | 20 | 1 | 6.5 | ±3.31 |
| 11 | 7500 | 135 | 0 | 128 | 16875 | Closed | 20 | 1 | 7.7 | ±3.29 |
| 12 | 7500 | 145 | 0 | 130 | 18125 | Closed | 20 | 1 | 9.0 | ±5.14 |
| 13 | 7500 | 135 | 0 | — | 16875 | Partial Open | — | * | 5.6 | ±4.74 |
| 14 | 7500 | 125 | 0 | 140 | 15625 | Closed | 15 | 0 | 9.24 | ±2.16 |
| 15 | 7500 | 125 | 0 | 140 | 15625 | Closed | 12 | 0 | 8.00 | ±2.14 |
| 16 | 7500 | 125 | 0 | 140 | 15625 | Closed | 15 | 0 | 8.2 | ±3.47 |
| 17 | 7500 | 125 | 0 | 140 | 15625 | Closed | 15 | 0 | 8.2 | ±1.99 |
| 18 | 5866 | 100 | 0 | | 9777 | Closed | 15 | 0 | 9.2 | ±3.17 |
| 19 | 5866 | 100 | 0 | | 977 | Closed | 15 | 0 | 11.0 | ±4.75 |
| 20 | 7000 | 105 | 0 | | 12250 | Closed | 15 | 0 | 8.41 | ±2.76 |
| 21 | 7000 | 100 | 0 | | 11666 | Closed | 15 | 0 | 7.57 | ±2.16 |

* - Areas of hot spots noted.

Test Results

Referring now to Table 1, while a one-spot experimental quench car was being constructed, moisture tests were performed on an existing quench car, (see Table 1, Test Nos. 1 thru 6). In each of these tests, incandescent coke was found in the car after quenching, including Test No. 3 where the average coke moisture was 21.56%. It should be noted that the coke distribution in the sampled quench cars were judged to be superior to that which is considered normal.

The experimental quench car as originally built had inside dimensions of 15'1" width, 21'6" length and 14'4" height. In addition, a dividing wall was installed in the center of the car to divide the coke load equally during a push, in the hope that two sets of data could be obtained from a single quench.

For Test No. 7, a flow rate of 9000 gpm, 120 second quench time, with a 25 second soak time was used. This produced coke of good moisture content 7.6%, but a relatively high standard deviation of ±4.18%. The coke from the bottom of the car was substantially higher in moisture content (12.7%) than the coke from the top of the car (4.1%). Although not reflected in the moisture analysis, a hot spot was found in the coke bed, just below the surface of the coke in the area of the coke peak. An additional spray was added to give better coverage of the coke peak area for the next tests. Additionally, the eruptions appeared to be reduced from a severe to a moderate range.

Test Nos. 8 and 9 were run at the same quenching conditions (except for quench water temperature which varied between 124° F. and 135° F.) of 10,000 gpm quench water flow rate, 135 seconds quench time, 22,500 total quench water volume, and zero soak time. These tests gave a more randomly distributed moisture analysis of the coke with respect to top moisture versus bottom moisture as noted in the table below:

| Test No. | Top | Bottom |
|---|---|---|
| 8 | 11.1% | 6.2% |
| 9 | 12.5% | 16.9% |

In this time frame, tests were run with three different coke distributing devices; a coke guide extension mounted on the test quench car, a coke guide extension mounted on the coke guide and a splitter mounted in the quench car. The splitter, a 24" diameter pipe, did little to distribute the coke and inhibited the quenching of the coke beneath it. The coke guide extension mounted on test quench car did give better distribution of the coke, but also presented some difficulty in quenching the coke shielded by the extension in the car. The coke guide extension mounted on the guide itself gave the best distribution of the coke but because of anticipated future maintenance difficulties with such a system, this approach was abandoned. In fact, all of the distributing devices were not appealing and it was hoped the volume of the car could be increased to eliminate the need.

For tests 10 and 11 six of the 10" nozzles were removed and replaced with 8" nozzles to reduce the quench water flow rate and maintain a well distributed water pattern. Quench time remained constant at 135 seconds with a 7500 gpm flow rate. Except for a 3–4% reduction in average coke moistures, the results were comparable to Tests No. 8 and 9. For Test 12, the quench time was increased for 10 seconds, with a corresponding increase in coke moisture. The hot spots in the above six tests were always near the area of the coke peak. On Test 13, the drain valves were forced to remain partially open and the quenching conditions used for Tests 10 and 11 were duplicated. Again a large amount of hot coke remained after the quench was completed.

Before proceeding with further testing, gates were added to the test quench car and vents were installed on the east side of the test quench car. A smaller quantity of quenching liquid was used on Test Nos. 14, 15, 16 and 17 by reducing the quench time to 125 seconds, with a total volume of quench water at 15,625 gallons. The results of these tests were much more consistant than any which had previously been taken as noted in the following table:

| Test No. | Avg. Moisture | Std. Dev. |
|---|---|---|
| 14 | 9.24 | ±2.16 |
| 15 | 8.00 | ±2.14 |
| 16 | 8.20 | ±3.47 |
| 17 | 8.20 | ±1.99 |

Test Nos. 14 and 15 used the extension mounted on the coke guide and Tests Nos. 16 and 17 used the extension mounted in the car. Although not indicated by the moisture analysis, small amounts of hot coke were present below the guide extension mounted in the car.

At this point in time it was decided to try a pipe quenching system. The sprays were removed from the quenching header and replaced with 4" straight pipes, approximately 18"–20" in length. A series of tests were run varying the quench time from 125 to 180 seconds. Again it was evident that if the car was allowed to drain while quenching or the soak time to go negative, substantially more water must be added to the coke bed to extinguish the hot coke. One major benefit from the pipe system was that the eruptions were not present, but rather a continuous "pop corn effect" of the coke took place. The centered pipes as installed also had the disturbing effect of washing coke out of the car. To alleviate this situation, a second header was attached to the original header on the bench side to allow a better distribution of the water and eliminate the water jet force from washing coke out of the car.

The new header contained twelve 4" straight pipes, four of which were plugged. Two of the pipes on the old header also remained in service to quench the coke under the guide extension device on the car. A quench practice which produced no hot coke was developed, i.e. 100 seconds quench time, for a total of 9780 gallons quench water volume at a rate of 5866 gpm. Several tests were conducted at various quench times. Two loads of coke were sampled using this practice, see Test Nos. 18 and 19. The average moistures were 9.2% and 11.00% respectively, and the standard deviations were higher (±3.17% and ±4.75%) than the previous tests. Straight pipes only were used in Tests 18 and 19. The lack of sprays resulted in poor distribution of the quenching liquid on the coke and accounts for the higher than desired average moistures.

Subsequent tests quenched in the above manner, although not sampled for coke moisture, produced a thoroughly quenched condition and the moisture content was visually judged to be consistently low.

Tests 20 and 21 were then run on a hybrid system of pipes and sprays. The pipes continued to remain open as in Tests 18 and 19, but three 8" sprays were added to cover the coke in the east side of the quench car. Quench times of 105 and 100 seconds were used at 7000 gpm. These tests produced coke moisture of 8.41 and 7.57, with standard deviation of ±2.76 and ±2.16 respectively. It should be noted that at the time of these tests, the test quench car had developed an appreciable amount of water leakage from warpage of the discharge door and jambs. It is thought that superior moisture figures could have been obtained from this system if the leakage was contained.

On one of the last tests, the metal bottom of the quench car was reversed in slope to see if there was any significant usable volume change in the coke as pushed. When this load of coke was quenched using the modified pipe head, only that portion of coke below where the pipes directed the water was quenched. The top portion of the coke remained incandescent. This load of coke had to be taken to the conventional quenching tower to complete the quench.

SPECIFIC EXAMPLE

The coke quenching practice of the instant invention was used to quench approximately 24 tons of hot coke from a 6 meter oven deposited in a one-spot watertight quench car in a deep conical shaped pile. The hot coke was contained in a one-spot watertight quench car having a horizontal surface area of approximately 388 sq. ft. (25'×15.5'). During the quench, the deep conical shaped coke pile was generally levelled to a relatively uniform depth of approximately 9 to 10 feet, which is approximately three times the depth obtained with conventional moving quench cars. This levelling is necessary to uniformly quench coke in the one-spot quench car.

The quenching process utilized three headers, one 18 inch diameter header 22 and two 12 inch diameter spray headers 23 and 24 which were located above the quench car in the quenching station. One header 22 was mounted adjacent the bench side of the quench car, one header 24 was located adjacent the wharf side and a third header 23 between the other two. There were 13 straight pipes mounted on the first quench header 22 adjacent the bench side and 10 full cone spray nozzles total on the other two headers 23 and 24. The full cone spray nozzles used to produce a full coverage spray pattern had a 75 degree included spray angle with a discharge opening of 3-11/32 inches diameter. Total average water flow rate through the spray system was about 7000 gallons per minute with pressures of 8 psig at header 22 and 5 psig at headers 23 and 24 respectively. The quenching liquid from the spray nozzles contacted about 60% of the substantially level exposed surface area of the coke in the quench car. Thus, the quenching liquid was applied to the coke in the quench car at a rate of about 15.5 gpm/sq. ft. of surface area contacted by the sprays. At this rate of water application the 24 tons of coke was quenched in 105 seconds.

It was discovered that a practical range for total flow of quench liquid was between about 9000 and about 12000 gallons to provide an efficient quench.

The quench cycle began when quenching liquid from a first set of spaced apart straight pipes 35 mounted on bench header 22 in a first pattern was applied to deliver streams of quenching liquid to the shallow coke bed portion for a period of about 100 seconds to cause the peak portion to subside by fluidizing the coke bed and thereby provide a substantially level exposed surface of coke in the quench car. As mentioned hereinbefore the rapid evolution of steam from the contacting of the quenching liquid with the red hot coke (approximately 2000° F.) fluidizes the coke particles allowing them to flow down the sides of the original conical pile into the corners of the car and assume a substantially level surface. The flow of quenching liquid from the spray nozzles mounted on the additional headers 23 and 24 commenced at about 80 seconds after the start of the quench cycle continuing after the flow from the straight pipes 35 had ceased.

Quench header 23 was provided with 6 full cone spray nozzles having 3-11/32 inches diameter openings delivering quenching liquid to the coke surface at the rate of approximately 4000 gpm. Quench header 24 was provided with 4 full cone sprays having 3-11/32 inches diameter openings delivering quenching liquid to the coke surface at a rate of 2600 gpm.

At the end of the quenching period all quench headers were turned off and the quench car was then drained by means of the drain mode of the discharge gate 28 provided with the one-spot watertight quench car.

The process provides for quenching hot coke in a substantially watertight one-spot quench car having a sloping bottom which slopes downwardly from the bench side of the quench car to the wharf side of the quench car and provides a shallow coke bed portion and a deep coke bed portion. The quench car is positioned in a quenching station beneath independently operable quench headers mounted substantially parallel to the longitudinal axis of the one-spot quench car and substantially coextensive therewith.

The quench car operator initiates the start of the quench after the car is properly spotted in the quenching station. After the first valve 25 opens, spaced apart solid streams of quenching liquid are projected from a first quench header 22 adjacent the bench side of the quench car onto the surface of the shallow coke bed portion 16 for a period of between about 90 and about 125 seconds.

At approximately 80 seconds quench valves 26 and 27 open and discharge a quantity of quenching liquid through full cone nozzle sprays 36 and 37 for the remainder of the quenching period. The flow of all quenching liquid then is shut off after a preset time of between 100–125 seconds and ceases to flow onto the surface of the coke bed.

After another preset time watertight one-spot quench car is drained of the unvaporized quenching liquid in the bottom of the car and the quenched coke is discharged onto the coke wharf.

The total volume of quenching liquid discharged during a single quenching cycle, between about 100 and 125 seconds, of a 24 ton (six meter oven) requires between about 9000 and about 12000 total gals. This calculates to between about 375 and about 500 gals/ton of coke quenched.

What is claimed is:

1. A process for producing coke having a uniform moisture content by quenching hot coke collected in first and second portions in a watertight quench car moved to a quenching station having first and second water delivery means through which water is directed upon the hot coke during a quench cycle in a manner that causes the hot coke to be quenched and the unvaporized portion of the water to be retained in the bottom of the car until completion of the quench cycle, the steps comprising:

(a) directing water in solid stream form from the first water delivery means on the first portion of the hot coke and water in spray form from the second water delivery means on the hot coke in a manner to quench the hot coke and cause the unvaporized portion of the water to collect in the bottom of the car, (b) ceasing directing water on the hot coke, (c) draining from the watertight coke quench car the unvaporized water which is retained in the bottom of the quench car, and (d) discharging the coke from the coke quench car, whereby coke is produced having an average moisture content of between about 4% and about 10% and a standard deviation from average coke moisture of less than about ±4%.

2. A process for producing coke having a uniform moisture content according to claim 1 wherein the quench car is a one-spot quench car.

3. A process for producing coke having a uniform moisture content according to claim 1 or 2 wherein the total volume of water is between about 375 and about 500 gals/ton of coke quenched.

4. A process for producing coke having a uniform moisture content according to claim 3 wherein the time that water is applied to the coke in the quench car is between about 100 seconds and about 125 seconds.

5. A process for producing coke having a uniform moisture content according to claims 1 or 2 wherein the time that water is applied to the coke in the quench car is between about 100 seconds and about 125 seconds.

6. A process according to claim 1 or 2, wherein the water in spray form contacts about 60% of the substantially level exposed surface of the coke in the car.

* * * * *